US011571731B2

(12) United States Patent
Yuan et al.

(10) Patent No.: US 11,571,731 B2
(45) Date of Patent: Feb. 7, 2023

(54) ULTRA-LOW TEMPERATURE FORMING METHOD FOR ULTRA-THIN CURVED PART OF HIGH-STRENGTH ALUMINUM ALLOY

(71) Applicant: DALIAN UNIVERSITY OF TECHNOLOGY, Dalian (CN)

(72) Inventors: Shijian Yuan, Dalian (CN); Xiaobo Fan, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 117 days.

(21) Appl. No.: 16/999,486

(22) Filed: Aug. 21, 2020

(65) Prior Publication Data

US 2022/0056561 A1 Feb. 24, 2022

(51) Int. Cl.

| | |
|---|---|
| ***B21D 39/03*** | (2006.01) |
| ***C22C 21/12*** | (2006.01) |
| ***C21D 7/02*** | (2006.01) |
| ***C22C 21/10*** | (2006.01) |
| ***C22C 21/08*** | (2006.01) |
| ***B21D 5/00*** | (2006.01) |
| ***B21D 7/08*** | (2006.01) |

(52) U.S. Cl.

CPC ..... *B21D 39/031* (2013.01); *B21D 5/00* (2013.01); *B21D 7/08* (2013.01); *B21D 7/085* (2013.01); *C21D 7/02* (2013.01); *C22C 21/08* (2013.01); *C22C 21/10* (2013.01); *C22C 21/12* (2013.01)

(58) Field of Classification Search

CPC ..... B21D 39/031; B21D 5/00; B21D 7/08; B21D 7/085; C21D 7/02; C22C 21/08; C22C 21/10; C22C 21/12

See application file for complete search history.

*Primary Examiner* — Moshe Wilensky

(74) *Attorney, Agent, or Firm* — James F. Lea, III; Gable Gotwals

(57) ABSTRACT

The present invention discloses a method for ultra-low temperature forming an ultra-thin curved part of a high-strength aluminum alloy. The method includes the following steps: step 1: selecting a cladding with a suitable thickness according to a wrinkle limit of a sheet; step 2: stacking the sheet and the cladding, then putting into a die, and closing a blank holder; step 3: filling a cavity of a female die with an ultra-low temperature medium to cool the sheet to below −160° C.; step 4: applying a set blank holding force by the blank holder, and enabling a male die to go down to form a thin-walled curved part; and step 5: opening the die and taking out the formed thin-walled curved part. The present invention utilizes the favorable formability of the high-strength aluminum alloy at the ultra-low temperature and the instability resistance of the thick sheet.

7 Claims, 3 Drawing Sheets

ULTRA-LOW TEMPERATURE FORMING METHOD FOR ULTRA-THIN CURVED PART OF HIGH-STRENGTH ALUMINUM ALLOY

TECHNICAL FIELD

The present invention relates to the technical field of sheet metal forming, in particular to a method for ultra-low temperature forming an ultra-thin curved part of a high-strength aluminum alloy.

BACKGROUND

The aluminum alloy is widely used as the main structural material in the aerospace, aviation and automotive fields due to its high specific strength and good corrosion resistance. It accounts for more than 50% of the structural mass of the launch vehicle and aircraft. As the new generation of transport equipment has increasingly higher requirements for light weight and reliability, there is an urgent need for a lightweight integral structure of high-strength aluminum alloy to replace the traditional multi-piece tailor-welded structure. In terms of material, the aluminum-lithium (Al—Li) alloy has higher strength and lighter weight than the existing aluminum alloy, and can reduce the structural weight by more than 15%. Therefore, the Al—Li alloy is very appropriate as the lightweight material for the aerospace equipment. In terms of structure, taking the dome of the carrier rocket tank as an example, the existing manufacturing process is still to weld multiple scalloped segments and the top cover into the tank dome. The process requires that each part is precisely formed to ensure high-precision assembly. However, the tailored welding will increase the thickness of the welding zone, causing problems such as heavy structure and welding deformation, which cannot meet the requirements of light weight and high reliability. To solve the problems, a series of high-strength aluminum alloy thin-walled curved parts, for example, Al—Li alloy thin-walled curved parts, are developed to form the integral tank dome.

These thin-walled curved parts have an ultra-small wall thickness. The thickness of the dome of the 2-meter-diameter tank is only 4-5 millimeters, and the thickness of the dome of the 5-meter-diameter tank is only a dozen millimeters. The ratio of the thickness to the diameter is less than 3‰, which is far less than the wrinkle formation limit. However, there are serious wrinkling defects in the integral forming process of the ultra-thin curved parts. At present, hydroforming is an advanced integral forming process for the thin-walled curved parts. The stress state of the suspended area is controlled by fluid pressure to prevent the wrinkling defects. However, the high-strength aluminum alloy has poor formability at room temperature, and cracking defects are prone to occur when wrinkling is controlled by the fluid pressure, so that such ultra-thin curved parts cannot be manufactured by the hydroforming process. In order to improve the formability of the high-strength aluminum alloy, a hot drawing process is developed to form deep-cavity curved parts with a relatively large depth/diameter ratio. Because the aluminum alloy will be severely softened under heating conditions, if the blank holding force is increased or a draw bead is set to control wrinkling, it is easy to cause concentrated deformation or even cracking in the suspended area (force transmission area). Overall, the prior art cannot solve the coexisting problems of wrinkling and cracking in the integral forming of the high-strength aluminum alloy ultra-thin curved parts.

SUMMARY

In order to solve the above problems existing in the prior art, an objective of the present invention is to provide a method for ultra-low temperature forming an ultra-thin curved part of a high-strength aluminum alloy. A sheet and a cladding are cooled and pressurized by using an ultra-low temperature medium in a die, so that an aluminum alloy is formed into an ultra-thin curved part under the action of the ultra-low temperature and the cladding to prevent wrinkling.

To achieve the above purpose, the present invention provides a method for ultra-low temperature forming an ultra-thin curved part of a high-strength aluminum alloy, including the following steps:

(1) selecting a cladding with a suitable thickness according to a wrinkle limit of a sheet;

(2) stacking the sheet and the cladding, then putting into a die, and closing a blank holder;

(3) filling a cavity of a female die with an ultra-low temperature medium to cool the sheet to below −160° C.;

(4) applying a set blank holding force by the blank holder, and enabling a male die to go down to form a thin-walled curved part; and (5) opening the die and taking out the formed thin-walled curved part.

Preferably, the cladding is made of pure aluminum, Al—Mg alloy, Al—Mg—Si alloy, low-carbon steel or stainless steel; a sum of thickness of the cladding and the sheet is greater than a critical wrinkling thickness.

Preferably, before step (2), the die is cooled to a set temperature lower than −160° C.; the die includes the blank holder and the female die; the blank holder and the female die are provided therein with a circulation path for circulating an ultra-low temperature medium; the die is cooled through the circulation path.

Preferably, before step (4), the pressure of the ultra-low temperature medium is increased (the pressure of the ultra-low temperature medium is set to not greater than 10 MPa) to increase an interface friction between the sheet and the cladding, so that the sheet is formed into the thin-walled curved part under a combined action of the pressure of the ultra-low temperature medium, the cladding and the die.

Preferably, before step (4), the male die is heat-insulated by using a low-temperature thermal insulation plastic film.

Preferably, a set temperature of the sheet and the die ranges from −160° C. to −270° C.

Preferably, the sheet is a rolled sheet with a wall thickness of 0.1-20 mm.

Preferably, the ultra-low temperature medium is liquid nitrogen, liquid argon or liquid helium.

Preferably, the sheet is made of Al—Cu alloy, Al—Mg—Si alloy, Al—Zn—Mg—Cu alloy or Al—Li alloy.

Compared with the prior art, the present invention achieves the following beneficial effects:

(1) The present invention deforms the aluminum alloy sheet at an ultra-low temperature, which significantly improves the formability, and avoids the problem of cracking in the formation of the high-strength aluminum alloy thin-walled curved part.

(2) The present invention increases the thickness of the sheet by using the cladding, which improves the instability resistance, suppresses wrinkling, and solves the problem of wrinkling in the formation of the ultra-thin curved part.

(3) The present invention uses the ultra-low temperature medium for cooling and pressurization, which improves an interface friction between the sheet and the cladding, promotes the coordinated deformation of the sheet and the cladding and prevents the ultra-thin sheet from wrinkling.

(4) The present invention uses the cladding to increase the thickness and keep cold, which ensures that the sheet is deformed at the temperature of the ultra-low temperature medium.

(5) The present invention uses the ultra-low temperature medium to directly cool the sheet, avoiding the problem of difficulty in cooling a large-sized die.

BRIEF DESCRIPTION OF DRAWINGS

To describe the technical solutions in the examples of the present invention or in the prior art more clearly, the accompanying drawings required for the examples are briefly described below. Apparently, the accompanying drawings in the following description show merely some examples of the present invention, and a person of ordinary skill in the art may still derive other accompanying drawings from these accompanying drawings without creative efforts. To describe the technical solutions in the examples of the present invention or in the prior art more clearly, the accompanying drawings required for describing the examples are briefly described below. Apparently, the accompanying drawings in the following description show merely some examples of the present invention, and a person of ordinary skill in the art may still derive other drawings from these accompanying drawings without creative efforts.

Figure 1:
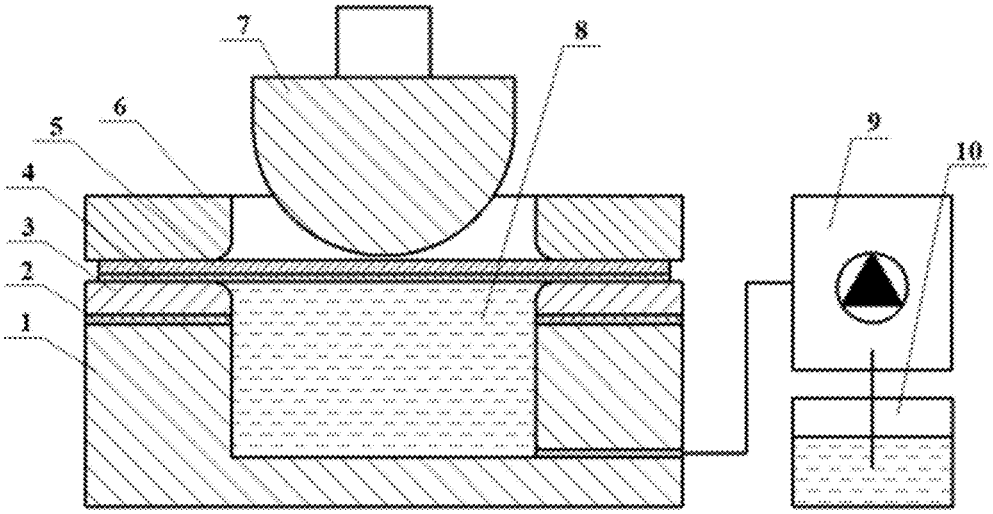
FIG. 1 is a schematic diagram of composition and cooling of an ultra-low temperature drawing die for a double-layer sheet.

1. female die holder; 2. heat insulation plate; 3. female die; 4. sheet; 5. cladding; 6. blank holder; 7. male die; 8. ultra-low temperature medium; 9. cryogenic pressurizer; 10. cryogenic container; 11. thin-walled curved part; 12. clad curved part; and 13. cooling pipe.

DETAILED DESCRIPTION

The technical solutions in the examples of the present invention are clearly to completely described below with reference to the accompanying drawings in the examples of the present invention. Apparently, the described examples are merely a part rather than all of the examples of the present invention. All other examples obtained by a person of ordinary skill in the art based on the examples of the present invention without creative efforts should fall within the protection scope of the present invention.

In order to solve the above problems existing in the prior art, an objective of the present invention is to provide a method for ultra-low temperature forming an ultra-thin curved part of a high-strength aluminum alloy. A sheet and a cladding are cooled and pressurized by using an ultra-low temperature medium in a die, so that an aluminum alloy is formed into an ultra-thin curved part under the action of the ultra-low temperature and the cladding to prevent wrinkling.

In order to make the above objectives, features and advantages of the present invention more understandable, the present invention will be described in further detail below with reference to the accompanying drawings and detailed examples.

In order to solve the coexisting problems of cracking and wrinkling in the prior art, the present invention provides a method for ultra-low temperature forming an ultra-thin curved part of a high-strength aluminum alloy. The present invention utilizes the favorable formability of the high-strength aluminum alloy at the ultra-low temperature and the instability resistance of a thick sheet. As shown in FIGS. 1 to 5, a core concept of the method is to cool and pressurize a sheet and a cladding by using an ultra-low temperature medium in a die, so that the aluminum alloy is formed into the ultra-thin curved part under the action of the ultra-low temperature and the cladding. The method specifically includes the following steps:

Step 1: select a cladding with a suitable thickness 5 according to a wrinkle limit of a sheet.

Step 2: stack the sheet 4 and the cladding 5, then put into a die, and close a blank holder 6, where preferably, the die is cooled to a set temperature lower than −160° C.; the die includes the blank holder 6 and a female die 3; the blank holder 6 and the female die 3 are provided therein with a circulation path for circulating an ultra-low temperature medium; the die is cooled through a cooling pipe 13 of the circulation path.

Step 3: fill a cavity of the female die 3 with the ultra-low temperature medium 8 to cool the sheet 4 to below −160° C.

Step 4: apply a set blank holding force by the blank holder 6, and enable the male die 7 to go down, so that the sheet 4 is formed into a thin-walled curved part 11 under a combined action of pressure of the ultra-low temperature medium, the cladding 5 and the die, where, preferably, the pressure of the ultra-low temperature medium 8 is increased (the pressure is set to not greater than 10 MPa) to increase an interface friction between the sheet 4 and the cladding 5; preferably, the male die 7 is also heat-insulated by using a low-temperature thermal insulation plastic film, so as to reduce the effect of the male die 7 on the temperature of the sheet 4.

Step 5: open the die and take out the formed thin-walled curved part 11.

Specifically, the cladding is made of pure aluminum, Al—Mg alloy, Al—Mg—Si alloy, low-carbon steel or stainless steel; a sum of thickness of the cladding 5 and the sheet 4 is greater than a critical wrinkling thickness; a set temperature of the sheet 4 and the die ranges from −160° C. to −270° C.; the sheet 4 is a rolled sheet with a wall thickness of 0.1-20 mm; the sheet is made of Al—Cu alloy, Al—Mg—Si alloy, Al—Zn—Mg—Cu alloy or Al—Li alloy; the ultra-low temperature medium 8 is liquid nitrogen, liquid argon or liquid helium.

EXAMPLE 1

Figure 2:
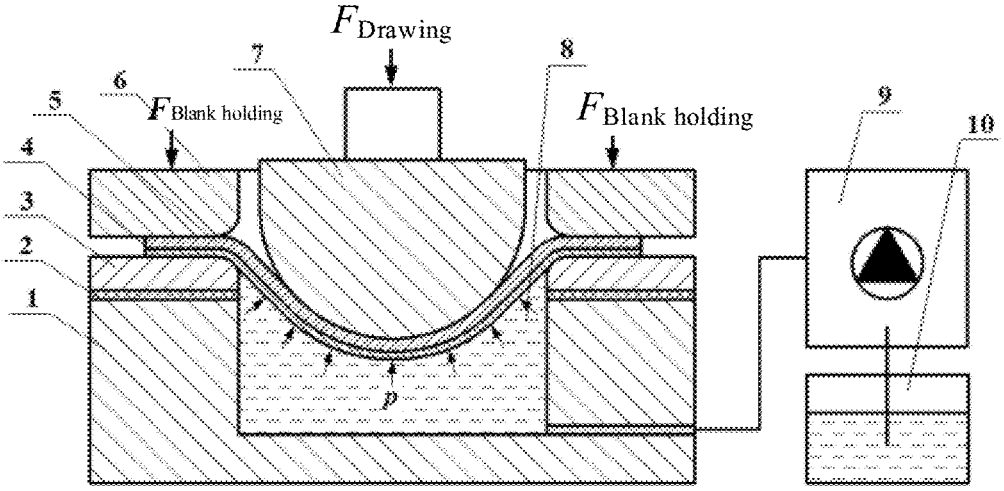
FIG. 2 is a schematic diagram of an ultra-low temperature drawing process of the double-layer sheet.
Figure 3:
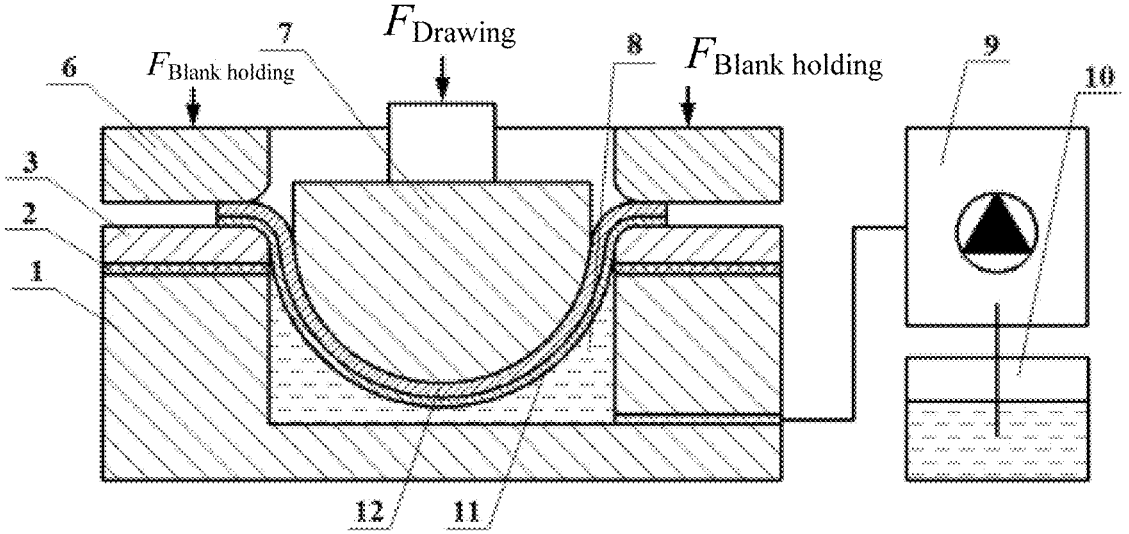
FIG. 3 is a schematic diagram of a completion stage of ultra-low temperature drawing of the double-layer sheet.

As shown in FIGS. 1, 2 and 3, in this example, a sheet 4 is made of solid solution 2195 Al—Li alloy, with a thickness of 1 mm and a diameter of 1,500 mm; a cladding 5 is made of pure aluminum, with a thickness of 14 mm and a diameter of 1,500 mm; a thin-walled curved part 11 forms a spherical bottom with an opening diameter of 1,000 mm; the sheet and the cladding are directly cooled by using an ultra-low temperature medium 8. The method specifically includes the following steps:

Step 1: select a suitable cladding made of pure aluminum and having a thickness of 14 mm according to a wrinkle limit of the sheet 4.

Step 2: stack the sheet 4 and the cladding 5 at room temperature after decontamination treatment, then put into a die, and close a blank holder 4 to press the sheet and the cladding.

Step 3: fill a cavity below the sheet 4 with the ultra-low temperature medium 8 by a cryogenic pressurizer 9 to cool the sheet 4 to below −180° C.

Step 4: apply a set blank holding force by the blank holder 6, and enable a male die 7 to go down, so that the sheet 4 is formed into the thin-walled curved part 11 and a clad curved part 12 under the set blank holding force and drawing process conditions.

Step 5: release the male die 7 and the blank holder 6, recover the ultra-low temperature medium 8 into a cryogenic container 10, open the die to take out the thin-walled curved part 11 to complete the ultra-low temperature forming of the thin-walled curved part 11, and artificially age the thin-walled curved part 11.

In this example, the ultra-low temperature medium 8 may be liquid nitrogen, liquid argon or liquid helium; the cladding 5 may be made of pure aluminum, Al—Mg alloy, Al—Mg—Si alloy or steel.

In this example, the sheet 4 is cooled to the ultra-low temperature by using the ultra-low temperature medium 8, so that the sheet 4 is deformed at the ultra-low temperature, which significantly improves the formability, and avoids the problem of cracking in the traditional drawing process of aluminum alloy thin-walled curved parts. The cladding is used to suppress the wrinkle of the thin sheet, solving the problem of wrinkling of the thin-walled curved part 11. The cladding 5 is used to increase the thickness to suppress wrinkles and to keep cold to ensure that the sheet 4 is deformed at the ultra-low temperature of the medium.

EXAMPLE 2

Figure 4:
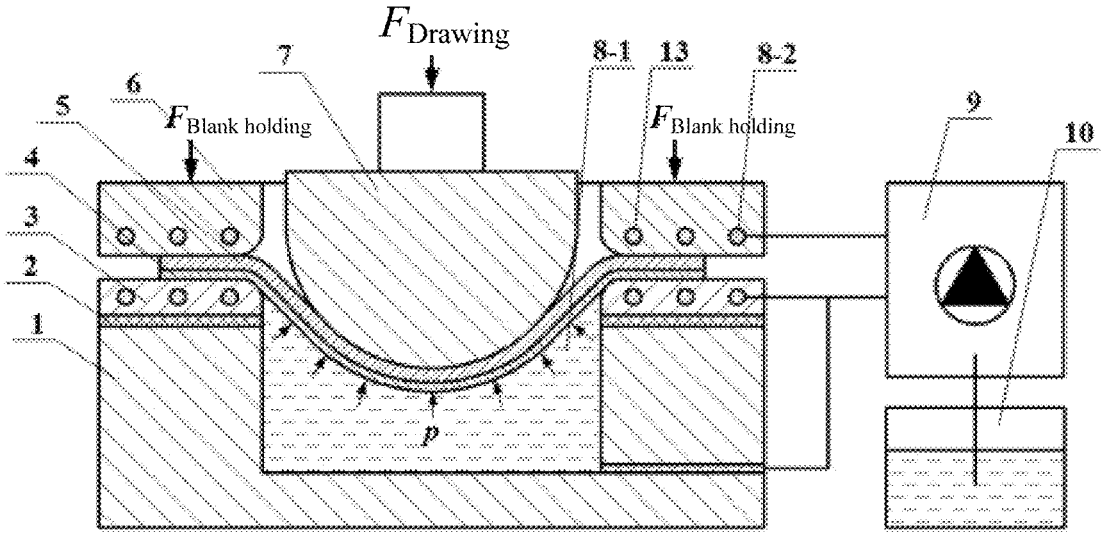
FIG. 4 is a schematic diagram of ultra-low temperature drawing of the double-layer sheet by pre-cooling the die.
Figure 5:
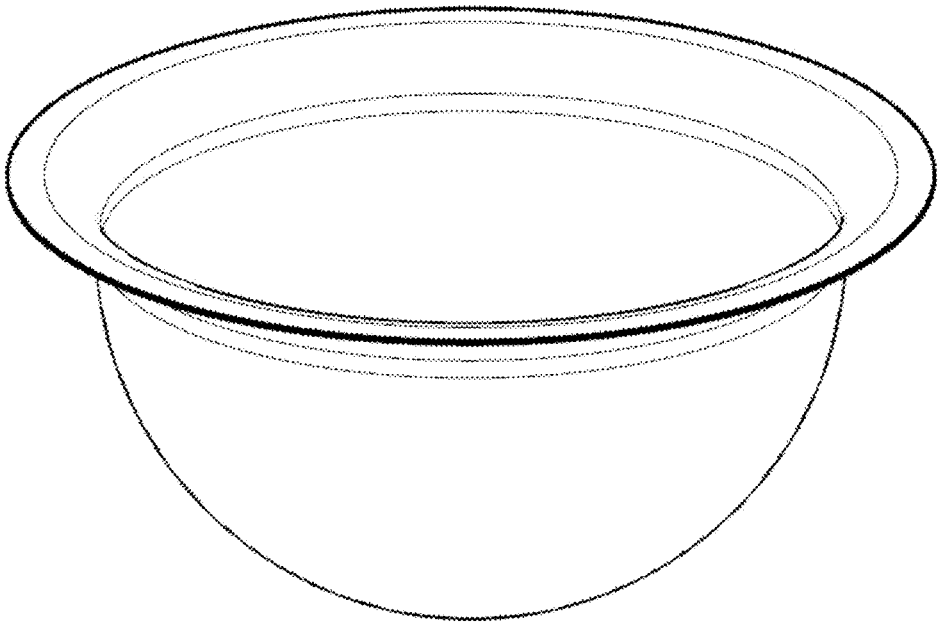
FIG. 5 is a high-strength aluminum alloy thin-walled curved part.

As shown in FIG. 4, in this example, a sheet 4 is made of 2219-T4 aluminum alloy, with a thickness of 4 mm and a diameter of 3,000 mm; a cladding 5 is made of 6061 aluminum alloy, with a thickness of 6 mm and a diameter of 3,000 mm; a thin-walled curved part 11 forms an ellipsoid bottom with an opening diameter of 2,000 mm and an axis length ratio of 1.4. The sheet and the cladding are directly cooled by using an ultra-low temperature medium 8, and indirectly cooled in a flange zone where a blank holder 6 and a female die 3 are pre-cooled. The method specifically includes the following steps:

Step 1: select a suitable cladding 5 made of 6061 aluminum alloy and having a thickness of 6 mm according to a wrinkle limit of the sheet 4.

Step 2: use liquid nitrogen as the ultra-low temperature medium 8 to cool both the female die 3 and the blank holder 6 to lower than −160° C., where the female die 3 and the blank holder 6 are provided therein with a cooling pipe 13 for circulating the ultra-low temperature medium 8; a die is cooled through the cooling pipe 13.

Step 3: stack the sheet 4 and the cladding 5 at room temperature after decontamination treatment, then put into the die, and close the blank holder 4 to press the sheet and the cladding.

Step 4: fill a cavity below the sheet with the ultra-low temperature medium 8 by a cryogenic pressurizer 9 to cool the sheet 4 to below −180° C.

Step 5: apply a set blank holding force by the blank holder 6, and enable a male die 7 to go down, so that the sheet is formed into the thin-walled curved part 11 and a clad curved part 12 under the set blank holding force and drawing process conditions.

Step 6: release the male die 7 and the blank holder 6, recover the ultra-low temperature medium 8 into a cryogenic container 10, open the die to take out the thin-walled curved part 11 to complete the ultra-low temperature gradient drawing of the thin-walled curved part 11, and artificially age the thin-walled curved part 11.

In this example, the ultra-low temperature medium 8 may be liquid nitrogen, liquid argon or liquid helium; the cladding 5 may be made of pure aluminum, Al—Mg alloy, Al—Mg—Si alloy or steel.

In this example, the sheet 4 is cooled to the ultra-low temperature by using the ultra-low temperature medium 8, so that the sheet 4 is deformed at the ultra-low temperature, which significantly improves the formability, and avoids the problem of cracking in the traditional drawing process of aluminum alloy thin-walled curved parts. The cladding 5 is used to suppress the wrinkle of the thin sheet, solving the problem of wrinkling of the thin-walled curved part 11. The cladding 5 is used to increase the thickness to suppress wrinkles and to keep cold to ensure that the sheet 4 is deformed at the ultra-low temperature of the medium. The die is pre-cooled to indirectly cool the sheet in the flange zone, which increases the blank holding force to increase the interface friction between the sheet 4 and the cladding 5, promotes the coordinated deformation of the sheet and the cladding, and prevents the ultra-thin sheet from wrinkling.

EXAMPLE 3

As shown in FIGS. 1, 2 and 3, in this example, a sheet 4 is made of solid solution 2195 Al—Li alloy, with a thickness of 1 mm and a diameter of 1,500 mm; a cladding 5 is made of 304 stainless steel, with a thickness of 7 mm and a diameter of 1,500 mm; a thin-walled curved part 11 forms an ellipsoid bottom with an opening diameter of 1,000 mm and an axis length ratio of 1.6; the sheet and the cladding are directly cooled and pressurized by using an ultra-low temperature medium 8. The method specifically includes the following steps:

Step 1: select a suitable cladding 5 made of stainless steel and having a thickness of 7 mm according to a wrinkle limit of the sheet 4.

Step 2: stack the sheet 4 and the cladding 5 at room temperature after decontamination treatment, then put into a die, and close a blank holder 4 to press the sheet and the cladding.

Step 3: fill a cavity below the sheet 4 with an ultra-low temperature medium 8 by a cryogenic pressurizer 9 to cool the sheet 4 to below −180° C., and then pressurize to 10 MPa to increase an interface friction between the sheet 4 and the cladding 5.

Step 4: apply a set blank holding force by the blank holder 6, and enable a male die 7 to go down, so that the sheet 4 is formed into the thin-walled curved part 11 and a clad curved part 12 under the preset blank holding force and drawing process conditions, where during this period, the pressure in the cavity is always maintained as 10 MPa.

Step 5: release the male die 7 and the blank holder 6, recover the ultra-low temperature medium 8 into a cryogenic container 10, open the die to take out the thin-walled curved part 11 to complete the ultra-low temperature gradient drawing of the thin-walled curved part 11, and artificially age the thin-walled curved part 11.

In this example, the ultra-low temperature medium 8 may be liquid nitrogen, liquid argon or liquid helium; the cladding 5 may be made of pure aluminum, Al—Mg alloy, Al—Mg—Si alloy or steel.

In this example, the sheet 4 is cooled to the ultra-low temperature by using the ultra-low temperature medium 8, so that the sheet 4 is deformed at the ultra-low temperature, which significantly improves the formability, and avoids the problem of cracking in the traditional drawing process of aluminum alloy thin-walled curved parts. The cladding 5 is used to suppress the wrinkle of the thin sheet, solving the problem of wrinkling of the thin-walled curved part 11. The ultra-low temperature medium is used for cooling and pressurization, which improves the interface friction between the sheet 4 and the cladding 5, promotes the coordinated deformation of the sheet and the cladding and prevents the ultra-thin sheet from wrinkling. The cladding 5 is used to increase the thickness to suppress wrinkles and to keep cold to ensure that the sheet 4 is deformed at the ultra-low temperature of the medium. The ultra-low temperature medium is used to directly cool the sheet 4, avoiding the problem of difficulty in cooling a large-sized die.

It should be noted that it is obvious to those skilled in the art that the present invention is not limited to the details of the above exemplary examples, and that the present invention can be implemented in other specific forms without departing from the spirit or basic features of the present invention. Therefore, the examples should be regarded as exemplary and non-limiting in every respect, and the scope of the present invention is defined by the appended claims rather than the above description, and all changes falling within the meaning and scope of equivalent elements of the claims should be included in the present invention, and any reference numbers in the claims should not be construed as a limitation to the claims involved.

Specific examples are used for illustration of the principles and implementations of the present invention. The description of the examples is only used to help illustrate the method and its core ideas of the present invention. In addition, persons of ordinary skill in the art can make various modifications in terms of specific examples and scope of application in accordance with the teachings of the present invention. In conclusion, the content of this specification should not be construed as a limitation to the present invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A method for ultra-low temperature forming an ultra-thin curved part of an aluminum alloy, comprising the following steps:

(1) providing a sheet with a thickness and made from aluminum alloy, and selecting a cladding with a suitable thickness according to a wrinkle limit of the sheet, so that when the sheet made of solid solution 2195 Al-Li alloy has a thickness of 1 mm and a diameter of 1,500 mm, a corresponding cladding made of pure aluminum and with a thickness of 14 mm and a diameter of 1,500 mm is selected, when the sheet made of 2219-T4 aluminum alloy has a thickness of 4 mm and a diameter of 3,000 mm, a corresponding cladding made of 6061 aluminum alloy and with a thickness of 6 mm and a diameter of 3,000 mm is selected, or when the sheet made of solid solution 2195 Al-Li alloy has a thickness of 1 mm and a diameter of 1,500 mm, a corresponding cladding made of 304 stainless steel and with a thickness of 7 mm and a diameter of 1,500 mm is selected;

(2) stacking the sheet and the cladding, then putting into a die, and closing a blank holder;

(3) cooling the sheet to below −160° C. by filling a cavity of a female die with a chilling medium;

(4) applying a set blank holding force by the blank holder, and enabling a male die to go down to form a curved part which has a wall thickness and an opening diameter with a ratio of less than 3‰ of the wall thickness to the opening diameter; and (5) opening the die and taking out the formed curved part.

2. The method for ultra-low temperature forming an ultra-thin curved part of an aluminum alloy according to claim 1, wherein before step (2), the die is cooled to a set temperature lower than −160° C.; the die comprises the blank holder and the female die; the blank holder and the female die are provided therein with a circulation path for circulating the chilling medium; the die is cooled through the circulation path.

3. The method for ultra-low temperature forming an ultra-thin curved part of an aluminum alloy according to claim 1, wherein before step (4), the pressure of the chilling medium is increased (the pressure of the chilling medium is set to not greater than 10 MPa) to increase an interface friction between the sheet and the cladding, so that the sheet is formed into the curved part under a combined action of the pressure of the chilling medium, the cladding and the die.

4. The method for ultra-low temperature forming an ultra-thin curved part of an aluminum alloy according to claim 1, wherein before step (4), the male die is heat-insulated by using a thermal insulation plastic film.

5. The method for ultra-low temperature forming an ultra-thin curved part of an aluminum alloy according to claim 1, wherein a set temperature of the sheet and the die ranges from −160° C. to −270° C.

6. The method for ultra-low temperature forming an ultra-thin curved part of an aluminum alloy according to claim 1, wherein the sheet is a rolled sheet with a wall thickness of 0.1-20 mm.

7. The method for ultra-low temperature forming an ultra-thin curved part of an aluminum alloy according to claim 1, wherein the chilling medium is liquid nitrogen, liquid argon or liquid helium.

* * * * *